United States Patent [19]

Borgnini

[11] Patent Number: 5,046,893

[45] Date of Patent: Sep. 10, 1991

[54] PANEL WITH A FRETTED TRANSVERSAL SECTION, TO BE MOUNTED LONGITUDINALLY AS A COVERING FOR THE INSIDE WALLS OF ROAD TUNNELS

[76] Inventor: Arsenio Borgnini, Via Alcide De Gasperi, 38, Valfabbrica (PG), Italy

[21] Appl. No.: 517,922

[22] Filed: May 2, 1990

[30] Foreign Application Priority Data

Dec. 29, 1988 [IT] Italy ..... 601/88[U]

[51] Int. Cl.[5] ..... E21D 11/00

[52] U.S. Cl. ..... 405/151; 405/124

[58] Field of Search ..... 405/124, 125, 126, 150, 405/151, 152, 153, 288

[56] References Cited

U.S. PATENT DOCUMENTS 3,438,211 4/1969 Zywietz et al. ..... 405/153 X
3,638,434 2/1972 Delaere ..... 405/126
4,459,064 7/1984 Berset ..... 405/150 X
4,465,404 8/1984 Heintzmann ..... 405/288

FOREIGN PATENT DOCUMENTS 408720 4/1934 United Kingdom ..... 405/151
506453 5/1939 United Kingdom ..... 405/151

*Primary Examiner*—David H. Corbin
*Attorney, Agent, or Firm*—Leonard Bloom

[57] ABSTRACT

This invention concerns paneling for the internal walls of road tunnels, preferably provided with a fretted transversal section and characterized by the remarkable simplicity with which it can be mounted and maintained, and able to guarantee the diffusion of the right amount of light inside the tunnels themselves, as well as efficiently containing any water which may seep from the walls of such tunnels.

7 Claims, 2 Drawing Sheets

PANEL WITH A FRETTED TRANSVERSAL SECTION, TO BE MOUNTED LONGITUDINALLY AS A COVERING FOR THE INSIDE WALLS OF ROAD TUNNELS

DISCLOSURE

The subject of this patent application is a panel to cover the internal walls of road tunnels, characterised by the remarkable simplicity with which it can be mounted and maintained and by the fact that it can guarantee optimal functionality with considerable advantages as regards the safety of the flow of traffic passing through.

The panel according to the invention was in fact produced following careful study of the difficulties which characterise the construction and maintenance of road tunnels as well as the dangers which may be encountered by road users while passing through such tunnels.

The first drawback in almost all road and motorway tunnels nowadays, is caused by the precarious holding capacity of the vaults or sides with regard to the possible infiltration of water, which may drip onto the roadway and form dangerous puddles; this infiltration can be particularly worrying during the cold months when the water can freeze and form large and heavy ice crystals at the tunnel vaults, which are a high risk element for vehicles in transit, due to the fact that they can easily fall onto the roadway: while on asphalted surfaces, it is easy to determine the formation of treacherous sheets of ice, which prove to be even more dangerous, in that they take drivers completely unawares.

For this reason, inside the tunnels at the points where most water collects, sheet sections are now transversally mounted at a short distance from the internal walls of the tunnel, which in practice, line the whole vault from the inside at the points where water could leak; this solution ensures that the water collected from the tunnel walls, flows behind this sheet covering and is conducted to the base of the sides of the tunnel itself, where often narrow pavements are situated inside the tunnels, and in this way, the formation of dangerous puddles or sheets of ice in the middle of the roadway is avoided.

In any case, it is hereby observed that a considerable amount of work is necessary to bend said sheet sections, which in fact, have to be subjected to roller-leveling in advance.

The presence of road tunnels also creates further problems particularly concerning the difficulties encountered by drivers in adapting to the differing degrees of light, during the day when they have to suddenly change from broad daylight to a much lower degree of light normally to be found inside one of these tunnels even if it is illuminated. In fact, above all in cases when the vehicle is travelling at considerable speed, the human eye only adapts to the different degree of light a fraction of a second later than it should; so this means that the first few meters of the tunnel are covered practically blindly, with all the dangerous consequences this may lead to.

To try and limit the negative effects of this, it has been attempted to paint the sides of road tunnels in light colours, usually white, up to a height of about three meters from the ground, in fact it is believed that in this way the artificial light produced inside the tunnel by the system of illumination and by the vehicle headlights can get maximum diffusion, so that the difference in light between the outside and the inside of the tunnel is reduced as far as possible, this being naturally to the advantage of the vehicles travelling therein.

It should be noted at this point that the solutions adopted to date to avoid the problems which emerge in the use of road tunnels do not seem to be particularly satisfactory; in fact, the sheet applied transversally to the internal walls of the tunnels to direct the water drainage are difficult to mount—especially where there are bends—, they are almost impossible to clean efficiently and they do not match the sections of the tunnel without a similar covering very well.

As regards the solution of painting the inner sides of tunnels white to improve the diffusion of artificial light, it should be noted that these painted sections preserve their colour for a very short time, in that they are subject to the penetration of humidity and to soiling rapidly, and consequently they lose their specific functional characteristics during the continuous transit of vehicles inside the tunnel, vehicles which in actual fact discharge dust, fumes, water and mud against the painted sides of the tunnel.

In consideration of these factors, at present it would be necessary to arrange for the periodic re-painting of the side walls of tunnels for their entire length; taking into account the number of tunnels on the entire road network, as well as the complexity and practical difficulties connected with the maintenance, it becomes evident that the side walls of road and motorway tunnels are destined to remain soiled and therefore of very little help in diffusing artificial light for most of their working lives.

Taking these problems which have not been solved so far into account, the product according to the invention was expressly designed and created and consequently, it would seem finally that a satisfactory and definitive solution to all the problems previously described has been found.

In fact, it concerns a panel in thin sheet provided with an ornamental transversal section on which various grooves appear; the height of this panel being inferior to its length, so that it is possible to cover, as required, long uninterrupted sections of tunnel sides and also any type of bend.

Moreover, a similar panel is also perfectly suitable to be adapted to the bends in the tunnel sections, in consideration of the fact that it has longitudinal grooves distanced from each other by as many flat sections which allow the panel to bend freely and adapt to any type of bend on a perpendicular plane to the longitudinal axis of the aforementioned grooves, in such a way as to conform to any possible profile of the vertical walls of the tunnel, even in proximity of the vault, where the bend radii gradually decrease in size.

It is also evident that by mounting these panels one above the other, it is possible to create an effective covering of the tunnel sides, multiplying the height of each single panel so that the right height can be reached according to the dimensions and characteristics of each individual tunnel.

Moreover, the mounting of said panel proves to be rather simple, in that no particular working process is required for its leveling; it being provided that this process be effected on special "omega" frames used for the mounting of the panel itself on the sides of the tunnel. In this respect, it is noted that these frames define a means for leveling the sheets and for securing the leveled sheets directly to the portions of the side walls of the tunnel that are carried thereby. As seen in FIG. 2, each frame has a central forward section that is secured to the sheets by any suitable means (such as bolting or welding) that are well known to those skilled in the art. Each frame also has a respective pair of rearward sections that are secured directly to the inside walls of the tunnel. Finally, each frame has a pair of legs, each of which extends between the central section and a respective rearward section, and each of which is adjustable for providing leveling of the sheets.

It is hereby stressed that due to this type of mounting solution, it is possible to create a wall covering which is perfectly smooth on the surface, even when the cement walls to be covered are not perfectly smooth but, as is often the case, actually bumpy or rough; in fact this roughness can be eliminated by shaping, slightly bending or shimming the "omega" frames, designed to assist in the positioning of the panels according to the invention. It is in fact understandable that by acting in this way, it becomes possible for the front surfaces of the various frames applied in sequence to the inside walls of a tunnel, to be perfectly aligned and coplanar, that is to say, the surfaces on which the panels in question will be mounted; obviously, for this reason, it will be possible for the covering panels which will subsequently be fitted to these "omega" frames, to contribute towards creating a continuous, regular and perfectly smooth covering surface.

The usefulness of a similar panel is widespread : first of all, its front surface can be painted white or in light colours, with the aim of diffusing artificial light inside the tunnel and moreover, the covering of the sides of a tunnel by positioning several panels of the type according to the invention, one above the other, can be advantageously linked with the traditional sheet sections transversally positioned at the points in the vaults where most water collects, so that this water can be correctly conveyed towards the sides of the tunnel, within the cavity between the actual walls of the tunnel and the rear surface of such paneling.

With particular reference to the surface painting of the panel according to the invention, it should be said that painting of this panel, rather than the bare side walls of the tunnel, proves to be extremely advantageous in that, should the front surface of these panels get dirty, it would not be necessary to re-paint them, but it would be sufficient merely to clean the painted surfaces in order to perfectly restore the tunnel paneling to its original aspect and efficiency.

It should be noted that the cleaning operation of the front surface of such panels, is not in the least hindered by the presence of the alternate concave and convex profiles longitudinally positioned on the panel, in as much as it is simple to comprehend that when cleaning the panels, by means of large brushes or similar instruments and closely following the outline of said profiles, it is possible to remove any type of dirt which may be lodged between the concave and convex profiles of the panel, these also having a transversal section which particularly facilitates the cleaning operation effected by means of traditional instruments.

Consequently, it is easy to understand how it is possible to arrange without difficulty an efficient service of frequent periodical cleaning of the internal paneling of road tunnels; in fact, it would be sufficient merely to arrange for a vehicle able, while in motion, to energetically spray a liquid detergent onto the surfaces to be cleaned and then to carry out strong scrubbing action—perhaps by means of large rotating brushes of the same height or higher than each panel—on the covering surface in question, in order to remove all trace of dirt lodged between the various longitudinal profiles of the panels.

In practice, a vehicle of this kind, by going through the tunnel in one direction, can complete the cleaning operation of all the panels mounted on one side of the tunnel in an extremely short time; it being necessary, of course for an identical operation to then be carried out on the other side of the tunnel.

Exactly how useful the invention really is, can be deduced from the fact that a rapid and efficient cleaning operation like the one just described would be practically impossible on other types of paneling, especially sheet panels with transversally positioned profiles, like the ones currently is use inside tunnels to convey any water which may collect to the sides.

The possibility of being able to carry out the rapid, frequent and economical cleaning of the front surfaces of this paneling guarantees that the panels according to the invention are maintained in good condition, with particular reference to their efficiency in diffusing light inside the tunnels.

Actually, if the painted surface of said panels stays clean, it is possible for the tunnel to be well lit even if the number of lights therein is reduced and sometimes only by means of the vehicle headlights, while the contrary is true in cases where the side walls of the tunnel are no longer able to diffuse light; in other words, this means that by mounting the painted panels in question in a tunnel and ensuring their efficiency in diffusing light, it is actually possible for the tunnel to be correctly and adequately lit by less lights or by less specific power, compared to what is currently required given the fact that often the internal walls of tunnels have totally lost their painted finish and are no longer able to diffuse light. It should be specified in any case that the application of long series of panels according to the invention to the front of the internal walls of tunnels does not create any difficulties in the periodical inspection of the conditions of these walls; inspections must be carried out quite frequently to check for any possible structural defects which may result in the cement used in the building of the tunnel.

To ensure that these checks can also be easily carried out in tunnels in which the inside walls are covered by the paneling in question, it is in fact provided that one or more of the horizontal rows of panels which make up the complete covering of the tunnel—most probably one of the middle rows—, are fixed to the aforementioned "omega" support frames by means of screws with tabs or other easily removable fixing means, in such a way that maintenance workers can periodically proceed with the rapid and simple removal of these rows of panels, check the conditions of the cement in the tunnel wall and just as quickly and easily replace the panel in its original position. Moreover, in order to further improve the functionality of the invention, it can be provided that the hollow space between each panel and the actual cement wall of the tunnel can be used to advantage for the installation of deadening panels, perhaps made of rock wool or other suitable material, and able to deaden the noise inevitably made inside the tunnel by motor vehicles passing through. Another technical solution aimed to improve the functionality of the invention is offered by a special detail which is adopted when rather long sections of tunnels have to be covered by several panels mounted consecutively in position.

In fact, in these cases, the pairs of panels have to be arranged in such a way that the end transversal edge of one overlaps the end transversal edge of the other; it is obvious however, that in the cleft which is created between the two respective overlapping edges of two consecutive panels, water may collect and be drawn to the front of the panel.

Generally this danger is avoided merely by the fact that in most cases the roadway of tunnels is at a certain gradient, and therefore any water which may have collected in these clefts, tends to drip naturally by gravity down the back of the panel without collecting and dripping from the front of the panel itself; this can happen because in such cases the fitter of two consecutive panels normally takes care to ensure that of the respective overlapping transversal edges of the two consecutive panels, the one on the outside is always in line with the gradient. However, in cases where the roadway of the tunnel is perfectly flat, there is a risk that the natural emptying of the clefts may not take place as described above, due to the lack of even a slight gradient which can assist in draining the water towards the rear of the paneling; but actually, in such cases, it is quite common for the water which penetrates said thin clefts to end up dripping on the front of the paneling.

In these latter cases, namely in tunnels with perfectly flat roadways, in between the respective overlapping edges of the two consecutive panels, an adhesive sealing tape can be installed of the same height as the panels themselves and of suitable width, in order to actually seal off the cleft between the overlapping edges of said panels and thereby eliminate any possibility of water getting through the cleft and dripping from the front surface of the paneling in question.

The panel according to the invention can also be used as a support for all the reflectors and road signs which may be positioned inside the tunnel; if required, the larger signs could be mounted on arms which close up, supported by the invention in question, in such a way that they can be pushed back and brought against the panels themselves, so as not to obstruct the continuity of the cleaning operation of the front surfaces of an entire section of paneling according to the invention. It should furthermore be stressed that the covering panel in question, can also be used to great advantage in any other type of tunnel, such as railway, underground, subway tunnels for example.

For further clarity of explanation, the description of the invention continues with reference to the attached drawings reproduced for illustrative and not limitative purposes, in which.

Figure 2:
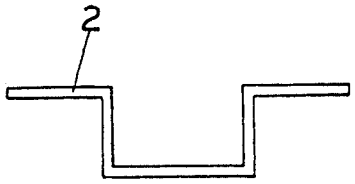
FIG. 2 is the transversal section of the metallic frame (of the type known as "Omega"), used in the mounting of the panel according to the invention on the walls of tunnels.
Figure 1:
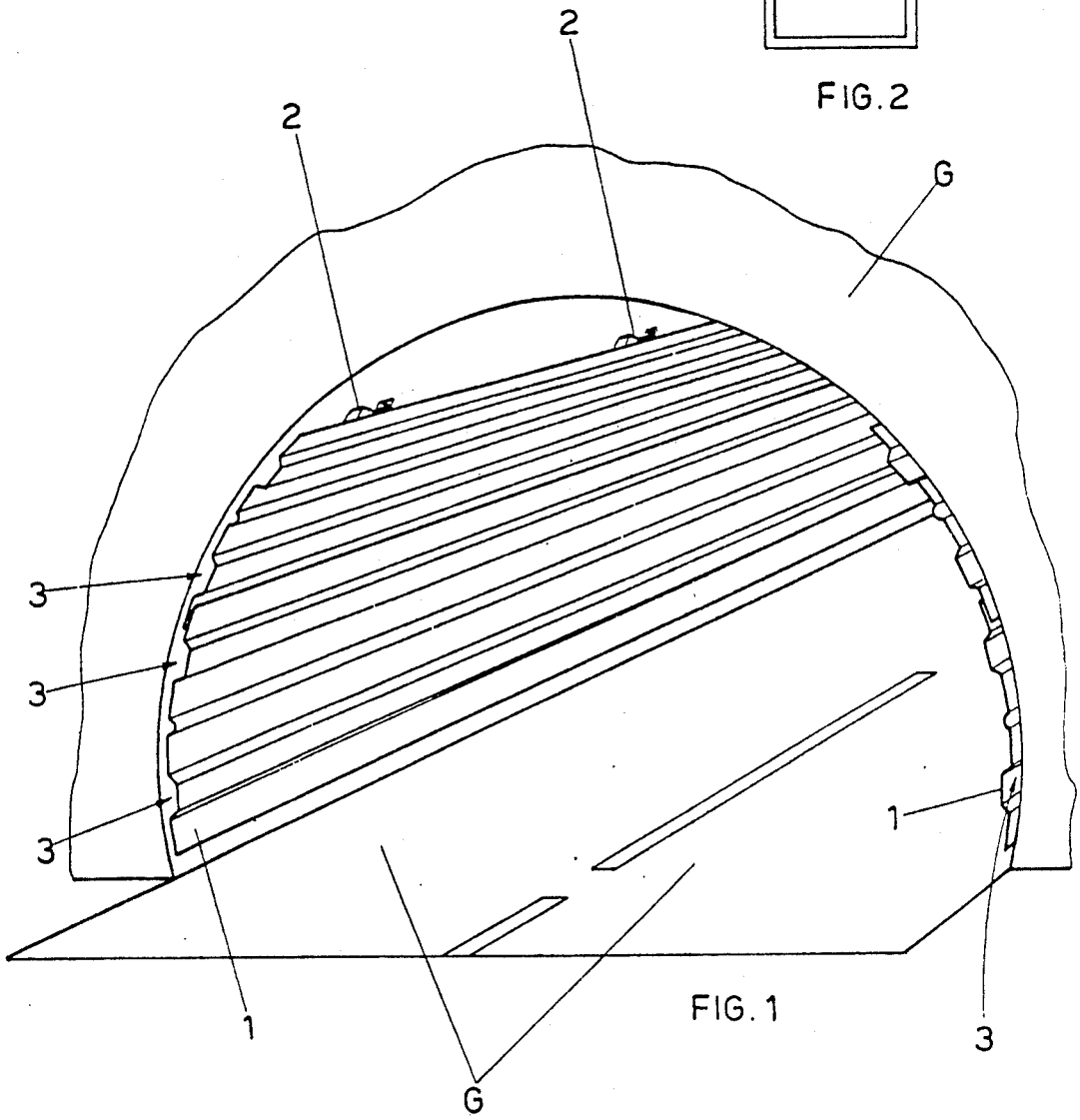
FIG. 1 is a schematic transversal section of a road tunnel in which the panel at reference has been mounted, part of which has been illustrated in a axonometric reproduction as from the respective section.

With reference to FIG. 1, the covering panel according to the invention (1), made of sheet or other suitable material, has a plurality of longitudinal convex sections formed therein, such that a fretted sheet having a front surface is defined thereby. As can further be seen in FIG. 1, each convex section includes a flat section that is bounded on opposite sides by respective outuwardly sloping side walls, so that an obtuse angle is defined therebetween. A similar panel (1) must be mounted on the inside walls of road tunnels (G), in such a way that the grooves (longitudinal convex sections) therein are parallel to each other and to the longitudinal axis of the tunnel (G). With reference to FIG. 1, the mounting of said panels (1) takes place in practice, by means of a spaced series of frames (2), made up of metallic profiles with an "omega" section, which after having been curved, are fixed on one side by means of leveling, to the inside walls of the tunnel, while on the other, they act as a means of connection and support for the actual panels (1). It is obvious that the positioning of the frames (2) in between the panels (1) and the inside walls of the tunnel (G), determines the formation of a hollow space (3), within which the water which seeps from the walls of the tunnel, can run and be conveyed.

Figure 3:
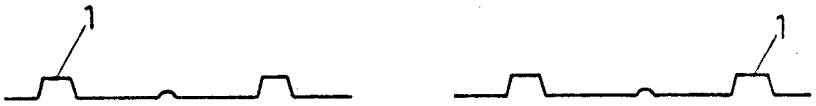
FIG. 3 represents one of the possible transversal sections which can be adapted to the covering panel according to the invention.

It is clear that apart from the embodiment illustrated in FIG. 3, the fretted transversal section can also be produced according to other different designs which are more or less equivalent; in any case, it should be noted that in order to facilitate the cleaning operation of the outer surface of the panel according to the methods previously described, it would be preferable for the convex profiles to have corners in which the flat surface is as large as possible in order to avoid the accumulation of dirt in tight corners which would make removal extremely difficult.

Figure 4:
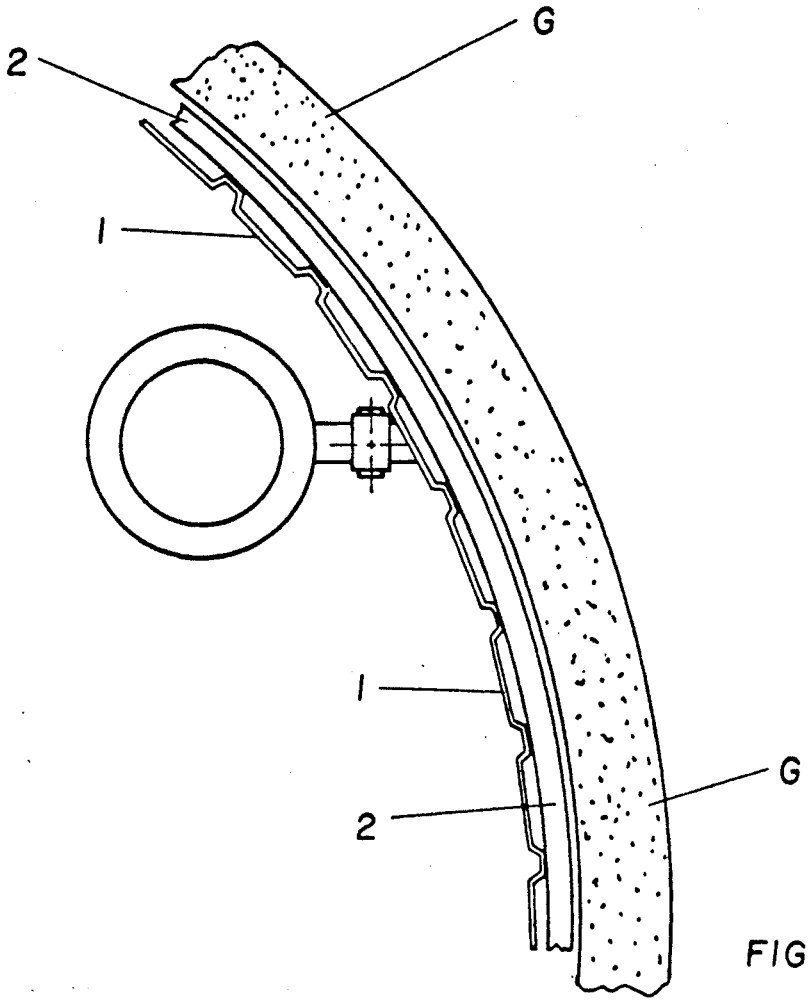
FIG. 4 illustrates the panel of the present invention carrying a road sign.
Figure 5:
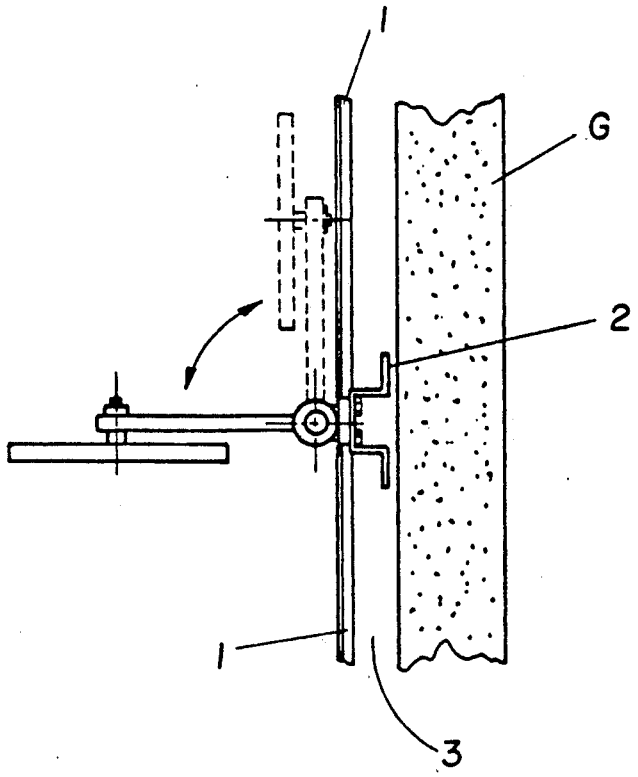
FIG. 5 illustrates the pivotal movement of the road sign of FIG. 4.

With reference now to FIGS. 4 and 5, if desired the panel 1 can be used as a support for reflectors and road signs which may be positioned in the tunnel. As contemplated herein, these signs may be mounted on mounting arms which pivotally close-up in such a fashion that they may be pivoted flush with the front surface of the sheets 1.

I claim:

1. A panel for providing a covering for the inside walls of a tunnel, comprising:

at least one sheet having a plurality of parallel longitudinal convex sections formed therein, such that a fretted sheet having a front surface is defined thereby, each convex section including a flat section bounded on opposite sides by respective outwardly sloping side walls, so that an obtuse angle is defined between the flat section and the side walls, each sheet further being flexible, so that the sheet may be adapted to the inclination of the inside walls; and means for leveling the sheets and for securing the leveled sheets directly to the portions of the inside walls of the tunnel that are to be covered, whereby a covering is provided that is smooth on the front surface even when the inside walls of the tunnel are not smooth, and further whereby the front surfaces of various of the sheets applied in sequence are perfectly aligned so as to be coplanar further creating a continuous regular and smooth front surface.

2. The panel of claim 1, wherein the sheets are plastic sheets.

3. The panel of claim 1, wherein the front surface of the sheets are of a color being substantially light enough to provide adequate diffusion of light inside the tunnel.

4. The panel of claim 1, wherein the parallel longitudinal convex sections are positioned being substantially parallel to the longitudinal axis of the tunnel.

5. The panel of claim 1, wherein a plurality of sheets are provided being disposed and secured in position one above the other for covering a particular height of the inside walls of the tunnel.

6. The panel of claim 1, wherein the means for leveling the sheets and for securing the leveled sheets directly to the portions of the inside walls of the tunnel being covered thereby is comprised of:

a plurality of frames having a central forward section being secured to the sheets, a pair of rearward sections disposed on opposite sides of the forward section and being secured directly to the inside walls of the tunnel, and a pair of legs, each leg extending between the central forward section and a respective rearward section, the legs being adjustable, such that the front surfaces of the sheets carried by the frames are smooth even when the inside walls of the tunnel are not smooth, and further whereby the front surfaces of various of the sheets applied in sequence are perfectly aligned so as to be coplanar creating a continuous regular and smooth front surface; and further whereby a space is defined between the sheets and the inside walls of the tunnel for containing rain water seeping from the walls of the tunnel and for conveying said rain water to a desired place.

7. The panel of claim 1, further comprised of:

mounting arms pivotally carried by the sheets, each of said arms having a road sign carried thereby, such that the sign may be pivoted flush with the front surface of the sheets.

* * * * *